US005997002A

United States Patent [19]

Goldman

[11] Patent Number: 5,997,002

[45] Date of Patent: Dec. 7, 1999

[54] CASINO CARD GAME

[76] Inventor: Arthur Goldman, 5149 N. La Crosse, Chicago, Ill. 60630

[21] Appl. No.: 09/118,452

[22] Filed: Jul. 17, 1998

[51] Int. Cl.[6] ..... A63F 1/00

[52] U.S. Cl. ..... 273/292; 273/306

[58] Field of Search ..... 273/292, 274, 273/309, 306; 463/13

[56] References Cited

U.S. PATENT DOCUMENTS

| | | | |
|---|---|---|---|
| 4,836,553 | 6/1989 | Suttle et al. | 273/292 |
| 5,098,107 | 3/1992 | Boylan et al. | 273/292 |
| 5,382,025 | 1/1995 | Sklansky et al. | 273/292 |
| 5,415,414 | 5/1995 | Savage | 273/292 |
| 5,417,430 | 5/1995 | Breeding | 273/292 |
| 5,489,101 | 2/1996 | Moody | 273/292 |
| 5,531,440 | 7/1996 | Dabrowski et al. | 463/12 |
| 5,584,486 | 12/1996 | Franklin | 273/292 |
| 5,653,444 | 8/1997 | Dahl | 273/274 |
| 5,657,993 | 8/1997 | Merlino et al. | 273/292 |
| 5,664,781 | 9/1997 | Feola | 273/292 |
| 5,678,821 | 10/1997 | Hedman | 273/292 |

*Primary Examiner*—Benjamin H. Layno

*Attorney, Agent, or Firm*—Townsend & Townsend and Crew LLP

[57] ABSTRACT

A poker-style casino card game wherein jokers are never wild. The game uses a 52 card standard playing deck plus an additional five Jokers for a total of 57 playing cards. A sixth "imaginary" or side Joker is deemed to be within a player's hand if he places one of the side bets. The other side bet provides for greater payout based on standard poker hand rankings. The player antes a first bet and any desired side bets. After seeing the first card of the dealer's hand, the player decides whether or not to proceed with the hand. If the player proceeds, he wagers a second bet.

36 Claims, 2 Drawing Sheets

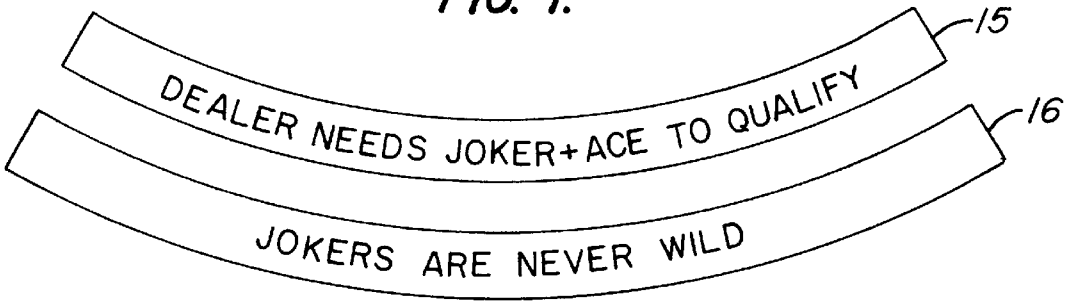
FIG. 1.
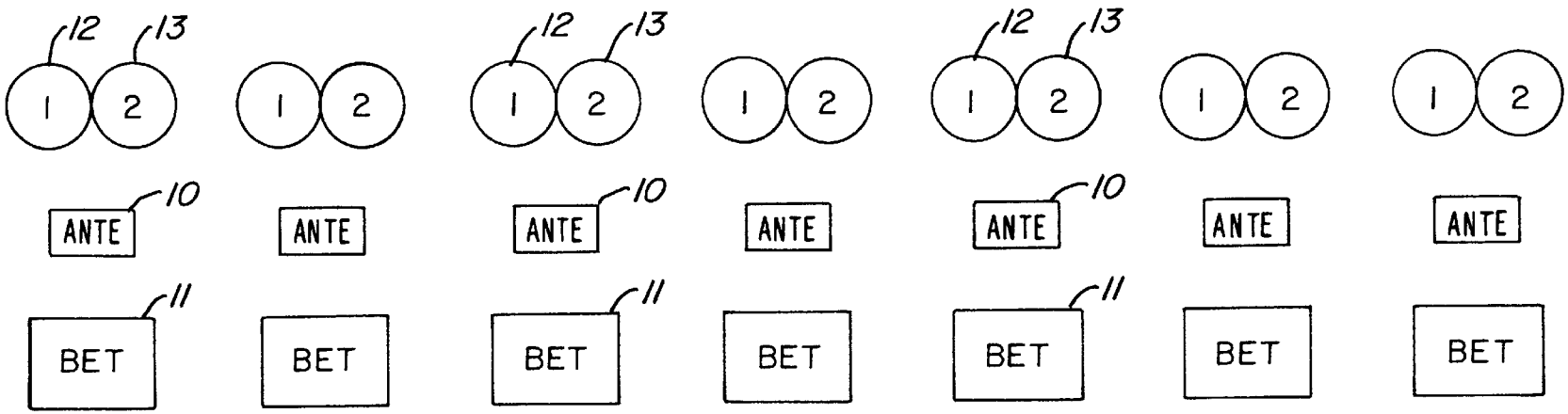

CASINO CARD GAME

BACKGROUND OF THE INVENTION

1. Field of the Invention

The present invention generally relates to a game of chance that can be played in a casino, and more particularly, to a modified version of a five-card stud poker game.

2. Description of the Prior Art

As a leisure time activity, poker and other card games have fascinated the public for years. A deck of cards, a playing surface, and a few participants are all that is needed to provide a recreational few hours away from the stress and strain of daily life. Five-card poker is a game that almost everyone knows how to play, and many games have developed using the same basic priority or rank order of winning poker hands: royal flush, straight flush, four of a kind, full house, flush, straight, three of a kind, two pairs, one pair, and high card(s) in hand.

For one reason or another, it has been difficult to adapt the rules of poker to a casino table game in which each player plays against the house. In a conventional poker game, a plurality of players are each dealt a poker hand by one player who acts as the dealer. The player with the highest hand based on the established priority of poker hands, wins. Each player in turn deals a hand as the game continues. It is not unknown to introduce wagering into the game, generally through the use of tokens or poker chips, which may or may not have a monetary value.

Many places, both within the United States and abroad, have legalized gaming and poker is one of the games of chance that is offered in both casinos and card rooms. In a conventional card room poker game, the house provides a dealer, the playing cards, the table and chairs, but does not play a hand. The house collects a nominal percentage of each player's bet (the "rake") that compensates the house for providing the facilities to the players. Alternatively, the house may charge each player a set amount per hand or for a specified length of time, e.g., one-half hour. Each player is competing not against the house, but against all the other players, with the highest hand winning the total of all the wagers made on that hand.

Many people do not like to play card room poker because each player is competing against his fellow players, not against the house. Many people would rather attempt to win money from an impersonal source, the house or the casino, rather than from their fellow players with whom they may be acquainted.

Card room poker also does not offer any bonus payments for particularly good hands. While a royal flush is a rare occurrence and generates a thrill for any poker player, the player collects the same total wager than he would have collected if all he needed to beat the other players was three of a kind.

SUMMARY OF THE INVENTION

A method of playing a poker-like game in accordance with the present invention that addresses the shortcomings of the prior art.

A method of playing a poker-like game comprises providing a 57-card deck of playing cards that comprises five jokers, shuffling the deck, at least one player anteing in a first wager, each player deciding whether to place a side bet, each player placing any chosen side bets, dealing a predetermined number of cards constituting a hand to each of each player and the dealer, turning at least one of the dealer's cards face up, and each player either folding or placing a second wager. The dealer turns up his remaining cards if at least one player did not fold and determines if he has a predetermined minimum qualifying hand. If the dealer does not have the predetermined minimum qualifying hand, any player that did not fold is paid based on the first wager and any chosen side bets. If the dealer does have the predetermined minimum qualifying hand, he compares the hand of each player that did not fold with the dealer's hand. The dealer then determines if each player that did not fold has a winning hand based on a predetermined ranking of hands. The predetermined ranking is based on standard poker hands and combinations ofjokers. Finally, the dealer determines if any players that did not fold won any side bets.

In accordance with one aspect of the present invention, the dealer is dealt his cards after all players have received their cards.

In accordance with another aspect of the present invention, the players are dealt their cards alternately.

In accordance with a further aspect of the present invention, each player is dealt his cards all at once.

In accordance with yet another aspect of the present invention, the second wager is twice the first wager.

In accordance with a further aspect of the present invention, a sixth joker is a community joker and any player who makes a first side bet may count the sixth joker as part of his hand.

In accordance with a further aspect of the present invention, each player decides whether to place two side bets.

In accordance with yet a further aspect of the present invention, any player who places two side bets receives joker jackpot insurance such that if any player at the table has a predetermined combination of cards and placed at least one side bet so that the predetermined combination of cards is a winning combination, the players having joker jackpot insurance also win.

In accordance with a further aspect of the present invention, the predetermined minimum qualifying hand is a joker and an ace.

Other features and advantages of the present invention will be understood upon reading and understanding the detailed description of the preferred exemplary embodiments, found herein below, in conjunction with reference to the drawings, in which like numerals represent like elements.

BRIEF DESCRIPTION OF THE DRAWINGS

FIG. 1 is a schematic illustration of a possible layout of a gaming table that may be used in conjunction with the playing of the present invention.

DETAILED DESCRIPTION OF THE PREFERRED EXEMPLARY EMBODIMENTS

Figure 2:
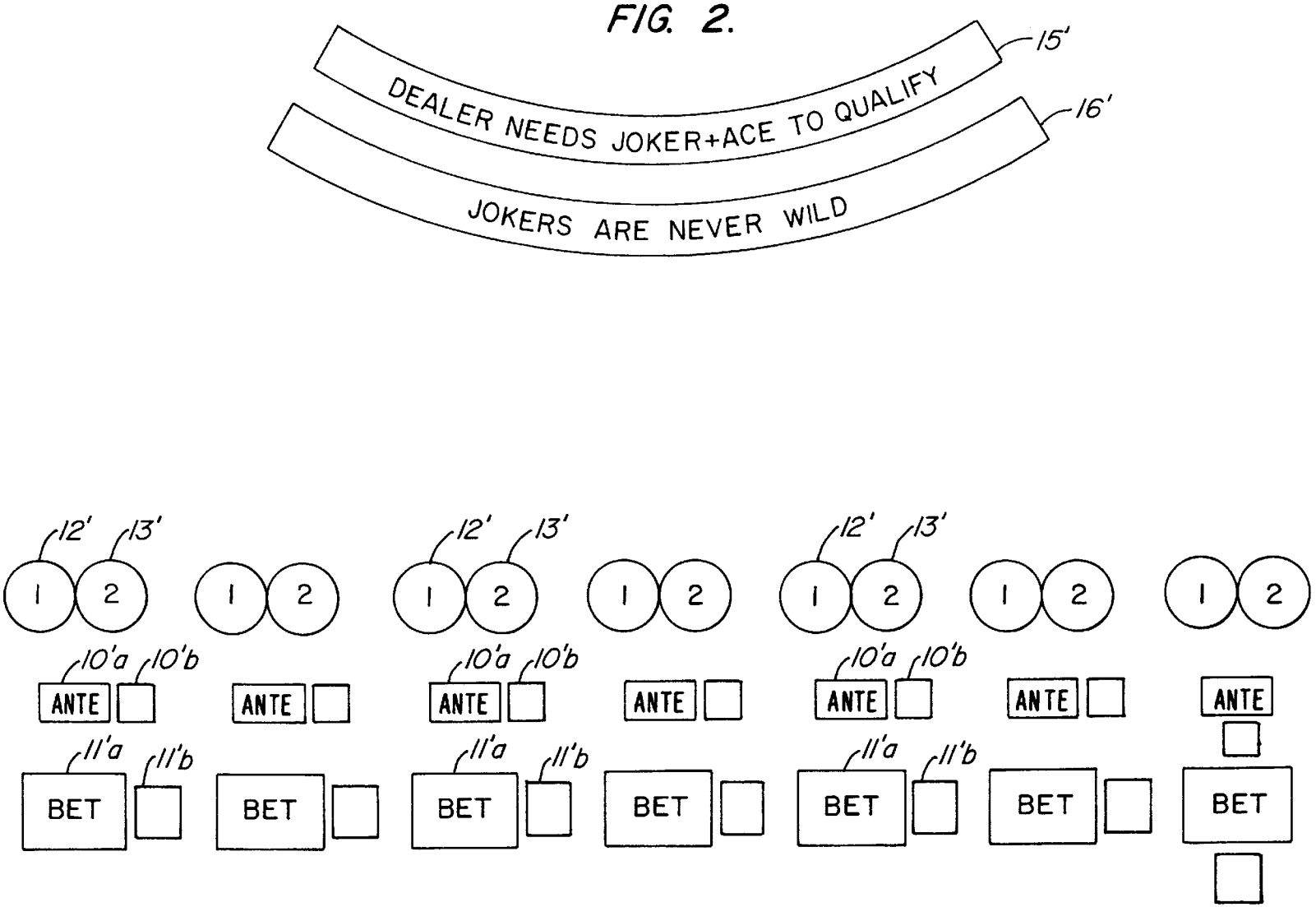
FIG. 2 is a schematic illustration of a possible layout of a gaming table that may be used in conjunction with the playing of an alternative embodiment of the present invention.

FIG. 1 illustrates a layout of a table that may be used when playing a poker-style game in accordance with the present invention. The table includes a plurality of locations 10 for placing ante bets, a plurality of locations 11 for placing playing bets, and a plurality of locations 12, 13 for placing side bets. The table further includes a dealer card location 14 for displaying the dealer's cards. Finally, in the preferred embodiment, locations 15, 16 are provided for indicating important rules of the game. FIG. 1 illustrates the saying that "dealer needs joker and ace to qualify in location 15 while location 16 indicates that jokers are never wild. Ample space is also provided for placement of players' cards.

For an alternative embodiment of a poker-style game in accordance with the present invention, FIG. 2 illustrates a table that includes a plurality of locations 10'*a, b* for placing two ante bets and a plurality of locations 11'*a, b* for placing two playing bets. The table also includes a plurality of locations 12', 13' for placing side bets. The table further includes a dealer card location 14' for displaying the dealer's cards. Finally, in the preferred embodiment, locations 15', 16' are provided for indicating important rules of the game. Ample space is also provided for placement of players' cards.

In accordance with a preferred embodiment of the present invention, the present poker-style game uses one standard deck of fifty-two playing cards, plus five jokers that are mixed in with the fifty two card deck. Thus, the total number of cards in the deck in the preferred embodiment is fifty-seven. In accordance with the present invention, jokers are never wild.

In a preferred embodiment, a sixth joker is provided that is not mixed in with the fifty-seven card playing deck. It may be considered real or imaginary and thus need not even be displayed. As will become apparent herein, all players may "purchase" the sixth joker by making an additional side bet. This side bet is placed in location 13. If this side bet is placed, the extra joker will be deemed to be part of the player's hand.

For the sequence of play, the dealer begins by shuffling the deck of 57 cards. Preferably, an automatic shuffling machine (not shown), which is well known in the art, is used to shuffle the cards. Players then place an ante bet in location 10 if the player is going to play the game. Preferably, the ante is one-half the amount of the ultimate playing bet. For example, a five dollar ante would indicate that the ultimate playing bet will be ten dollars for a total of fifteen dollars.

Players then decide if they are going to make any side bets. All side bets must be placed before any cards are dealt. In a preferred embodiment, a player has a choice of two side bets. Accordingly, to place a side bet, the player places the desired side bet in location 12 and/or 13. In a preferred embodiment, each side bet is between one dollar and five dollars. Preferably, the amount may be one dollar, two and a half dollars or five dollars. The side bets will be further described herein below.

In a preferred embodiment, a player who makes both side bets is deemed to receive joker jackpot insurance. Joker jackpot insurance pays all players who have made both side bets and who do not have the ultimate winning cards in their hands as will be explained more fully hereinbelow.

After the ante and side bets have been made, five cards are dealt, preferably face down, to each player. The dealer then deals five cards for himself after all other players have been dealt their cards. When dealing to the players, the dealer may deal one card at a time to each player or may deal all five cards at a time to each player as desired.

In a preferred embodiment, one of the dealer's cards is then revealed to the players. Depending on the location running the games, zero to four of the dealer's cards may be revealed. Players compare their cards and the dealer's face-up card, thus giving the player a slight advantage. For example, if a player has two fours in his hand and the dealer's face-up card is a five, the player would have to be slightly more cautious because the dealer could easily have a second five in his remaining four cards. Conversely, if the dealer has a three as the face-up card, the player would be in a stronger position to win.

At this point in the game, the player has two choices. First, if a player looks at his cards and decides he has a poor or unfavorable hand, he may fold or forfeit his ante wager. The ante wager preferably includes the side bets at this point. This may change depending on the location running the game. Alternatively, if a player likes his cards and believes he has a good hand, i.e., that he has a favorable chance of winning, he may place a playing bet in location 11, which in a preferred embodiment is marked "bet."

After all playing bets are made, the dealer displays his remaining four cards. In a preferred embodiment, the dealer must have a minimum opening or qualifying hand or higher to continue. In a preferred embodiment, the minimum qualifying hand is one joker and one ace. Under the rules of poker, the next higher hand is a pair of twos. If the dealer does not have the minimum opening hand, the hand/round is over. The dealer collects the cards and pays, in a preferred embodiment, even money to the players who stayed in the hand based on their ante. If the dealer qualifies with an appropriate opening hand and the player's hand beats the dealer's hand, the dealer pays all winning playing bets preferably according to the ranking rules of poker, in accordance with the Poker Paytable illustrated in Table 1 based upon the amount of the playing bet (five jokers preferably pays 50-1 and six jokers preferably pays 100-1), in addition to even money for the amount of the ante. If, on the other hand, the dealer's hand beats the player's hand, the dealer collects the losing player's ante and playing bet.

Thus, for example, a player who places a five dollar ante in location 10 and stays in will have five dollars in the ante location 10 and ten dollars in the bet location 11, thus having fifteen dollars total bet for that hand. If the dealer does not have the minimum opening hand, the player will receive five dollars, i.e., even money for the ante portion of the wager. If the dealer does have a minimum opening hand or higher, and the player beats the dealer's hand with, for example a straight, the player will be paid forty-five dollars, i.e., even money for the five dollar ante and four times the ten dollar playing bet. Additionally, all players who placed a playing bet will be paid any money won based on side bets they placed as will be described further herein below.

Preferably, the dealer compares hands and determines winners and losers starting at position 20 indicated in FIG. 1 and proceeding to the left to position 21 and so on based on where players are seated. Additionally, preferably the dealer collects all losing bets and antes and then pays all winning bets.

As the dealer reviews each hand, he checks to see if any player qualifies for any side bet jackpot bonus payouts that will be further described herein. Once the dealer has finished comparing hands and all winners have been paid and all losers' money has been collected, the dealer will preferably begin a new hand by shuffling the cards.

The odds and amounts listed in Table 1 may change depending upon the location running the game.

TABLE 1

Example Poker Hands Paytables

| Poker Playing Bet Paytable | | Poker Progressive Paytable (Side Bet #1) | |
|---|---|---|---|
| 1 pair | Even | Royal Flush | 100% of Progressive Jackpot Meter |
| 2 pair | 2–1 | Straight Flush | 10% of Progressive Jackpot Meter |
| 3 of a kind | 3–1 | 4 of a Kind | $150.00 |
| Straight | 4–1 | Full House | $75.00 |
| Flush | 6–1 | Flush | $50.00 |
| Full House | 8–1 | | |
| Four of a Kind | 22–1 | | |
| Straight Flush | 55–1 | | |
| Royal Flush | 110–1 | | |

In a preferred embodiment, a first progressive jackpot, preferably referred to as the progressive poker jackpot, is maintained for the first side bet, preferably referred to as the poker side bet. Table 1 illustrates examples of payout information for the poker side bet in one embodiment. If a player who placed a poker side bet receives a flush, that player will be paid fifty dollars, which is subtracted from the progressive poker jackpot. A full house pays seventy-five dollars, and four of a kind pays one hundred and fifty dollars. A player who has a straight flush and made the first side bet receives ten percent of the progressive poker jackpot, while a player with a royal flush receives one hundred percent of the progressive jackpot. The amounts can of course change depending upon the location running the game.

All amounts paid for the flush, full house, four of a kind, straight flush, and royal flush are preferably subtracted from the progressive poker jackpot. Preferably, the progressive poker jackpot starts at ten thousand dollars and increases by between twenty-five cents to as much as seventy-five cents per one dollar side bet wager, depending on the location running the game.

TABLE 2

Example Joker Side Bet Paytables

| Joker Progressive Paytable | | Joker Jackpot Insurance Paytable | |
|---|---|---|---|
| 3 Jokers in your hand | Even | 3 Jokers in other player's hands | $5.00 |
| 4 Jokers in your hand | 15–1 | 4 Jokers in other player's hands | 2–1 |
| 5 Jokers in your hand | 100–1 | 5 Jokers in other player's hands | 50–1 |
| 6 Jokers in your hand | 100% of Progressive Joker Jackpot Meter | 6 Jokers in other player's hands | 1500–1 |

As can be seen in Table 2, for the second side bet, preferably referred to as the joker side bet, a player having three jokers in his hand (including the extra or imaginary joker) receives even money, i.e., an amount equal to the side bet. Four jokers pays 15-1, while five jokers pays 100-1. In a preferred embodiment, a second progressive jackpot, preferably referred to as the progressive poker jackpot, is maintained for the joker side bet. A player who receives six jokers, i.e., five in his hand plus the extra or purchased joker, receives one hundred percent of the progressive jokerjackpot. As in the case of the poker progressive jackpot, the progressive joker jackpot preferably starts at a minimum of ten thousand dollars and increases by between twenty-five cents to seventy-five cents per one dollar side bet wager.

The amounts and odds listed in Table 2 may change depending upon the location running the game.

As discussed previously, players who make both side bets receive joker jackpot insurance. If a player who has joker jackpot insurance does not have the winning cards in his hand, the player may also receive a payout if another player made the corresponding side bet and had a "winning" combination of cards. For example, if another player at the table has three jokers in their hand (including the extra purchased or imaginary joker), and made the joker side bet, a player with joker jackpot insurance receives five dollars. If a player at the table has four jokers in their hand, the joker jackpot insurance pays 15-1. Five jokers in another player's hands pays 50-1 while six jokers in another player's hand pays 1500-1. Accordingly, a player with joker jackpot insurance may win even if that player's hand does not beat the dealer's hand. However, the player must remain in the game and not fold upon seeing the dealer's first card in order to receive a payment based on the joker jackpot insurance.

TABLE 3

Joker Ranking

| Number of Jokers in Hand | Pays |
|---|---|
| 3 Jokers beats any 3 of a Kind | Pays Even Money Plus Applicable Bonus |
| 4 Jokers beats any 4 of a Kind | Pays Even Money Plus Applicable Bonus |
| 5 Jokers beats any Straight Flush | Pays Even Money Plus Applicable Bonus |
| 6 Jokers beats any Royal Flush | Pays Even Money Plus Applicable Bonus |

Table 3 illustrates the ranking of joker hands versus standard poker hands and the amount paid. Basically, three jokers beat any three of a kind, four jokers beat any four of a kind, five jokers beat any straight flush, and six jokers beat any royal flush. Even money is preferably paid plus any applicable bonus. In an alternative embodiment, jokers would have no ranking, i.e., any poker hand would beat the jokers. The jokers would only be paid winnings based on having placed a joker side bet.

In an alternative embodiment, the game may be played without providing a sixth or community joker. In such an embodiment, placing a joker side bet may qualify the player for bonuses and joker jackpot insurance (if the poker side bet is also made), if these are included in the game. Table 4 illustrates the ranking of joker hands in this alternative embodiment.

The payment information in Tables 3 and 4 may change depending on the location running the game.

TABLE 4

Joker Ranking (Alternate Embodiment)

| Number of Jokers in Hand | Pays |
|---|---|
| 3 Jokers beats any 3 of a Kind | Pays Even Money Plus Applicable Bonus |
| 4 Jokers beats any 4 of a Kind | Pays Even Money Plus Applicable Bonus |
| 5 Jokers beats any Straight Flush | Pays Even Money Plus Applicable Bonus |
| 6 Jokers beats any Royal Flush | Pays Even Money Plus Applicable Bonus |

If it is desired, super bonuses may also be included. Super bonuses are paid when two hands appear during the same game. Table 5 illustrates some examples of super bonuses and the examples of the amounts split between the two players with the hands. If desired, it may be a requirement that a side bet be placed in order to qualify for a super bonus.

TABLE 5

| Super Bonus | Combination |
|---|---|
| I | 6 Jokers and Royal Flush $100,000 |
| II | 5 Jokers and Straight Flush $50,000 |
| III | Royal Flush and Straight Flush $25,000 |
| IV | Straight Flush and Four Of A Kind $5000.00 |
| V | Flush and Full House $2000.00 |
| VI | Flush and a Straight $1000.00 |

If the dealer holds one of the two hands, the dealer's share of the super bonus is preferably added to the corresponding progressive jackpot. Additionally, if the dealer's hand beats the player's hand, the player preferably only receives half of his share. For example, if a player has four of a kind and the dealer has a straight flush, then the player receives $1,250.00 under the super bonus V example in Table 5.

Super bonuses are preferably paid from the corresponding progressive jackpots. If a super bonus is based on both ajoker hand and a poker hand they may be split or apportioned between the progressive jackpots.

The amounts and hand combinations may change depending on the location running the game. Also, the splitting of the amounts won may change depending on the location running the game. For example, if the dealer has one of the hands, the player may receive the entire super bonus. Also, rather than splitting the super bonus, the player with the higher ranking hand may receive a larger percentage of the super bonus.

Additionally, the amount of the side bets placed may be used to determine for which super bonuses a player may qualify. Table 6 illustrates a sample range. The ranges and super bonuses may change depending on the location running the game.

TABLE 6

| Super Bonus Qualified For | Amount of Side Bet |
|---|---|
| All | $5.00 Poker Side Bet<br>$5.00 Joker Side Bet |
| III–VI | $2.50 Poker Side Bet<br>$2.50 Joker Side Bet |
| V–VI | $1.00 Poker Side Bet<br>$1.00 Joker Side Bet |

Alternatively, side bet amounts may be used to determine what percentage of a super bonus a player is paid, i.e., a side bet qualifies a player for all super bonuses and the amount of the side bet determines how much a player may win.

In an alternative preferred embodiment, players may ante and place their playing bets to play a "poker" hand and a "joker" hand with their five cards. For example, a player may place a five dollar poker ante, a two dollar joker ante, a one dollar poker side bet and a one dollar joker side bet. Thus, the player will have jokerjackpot insurance. The player is then dealt five cards—three jokers and two aces. The player decides to continue playing and therefore places a ten dollar poker playing bet (twice the poker ante) and a four dollar joker playing bet (twice the joker ante). Because the player made the joker side bet, his hand is four jokers and two aces. The dealer reveals his remaining cards and has a total hand of two kings. The player wins five dollars for his poker ante, ten dollars for his poker playing bet (two aces beats two kings—one pair pays even money, see Table 1), two dollars for his joker ante, eight dollars for his joker playing bet and fifteen dollars for joker side bet (see Table 7). Table 7 illustrates examples of payouts for the joker hands. Joker Jackpot Insurance pays as previously described and is still obtained by placing both side bets.

The player may fold his poker hand and continue with his joker hand, or vice versa, if desired.

TABLE 7

Example Joker Paytables (Alternative Embodiment)

| Jokers in Hand | Joker Progressive (Side Bet) Paytable |
|---|---|
| 3 Jokers Pays Even Money | 3 Jokers Pays Even Money |
| 4 Jokers Pays 2-1 | 4 Jokers Pays 15-1 |
| 5 Jokers Pays 50-1 | 5 Jokers Pays 100-1 |
| 6 Jokers Pays 100-1 | 6 Jokers Pays 100% of Progressive Joker Jackpot |

FIG. 2 illustrates a possible layout for a table that may be used to play the above alternative embodiment of the game.

As described before, only the ante and any wagered side bets are lost by folding after seeing the dealer's first card. A player may continue with just the poker hand or with just the joker hand by placing the corresponding playing bet and surrendering the corresponding ante.

The amounts payable for all of the bonuses may vary depending upon the location that is operating the game.

A side bet may also be included where a player bets on the dealer. Such a side bet may pay even money or may pay an amount based on the dealer's hand. The side bet may pay only if the dealer beats the player or based on the dealer's hand. Such a side bet allows a player to "hedge" his total bet similar to insurance in Blackjack.

In the preferred embodiment, the table includes meters (not shown) that illustrate the amount in each progressive jackpot.

Additionally, tables may be designed that include automated slots (not shown) for receiving the bets as opposed to locations 10 and 11. In such table arrangements, it is the player's responsibility to ensure that money placed in the slots has been registered.

The following rules are examples of rules that may be used with the various embodiments. Of course, the location running the game will determine the ultimate rules to be used.

The dealer must always have a minimum opening hand, preferably a joker and an ace, to open with in order to continue the hand. If he does not, he pays each player even money on the ante wager. However, if the player has a high enough hand and has made any side bets, the player will still be entitled to bonus amounts as previously discussed above.

If two players each receive a royal flush in the same hand, they will share the progressive royal flush jackpot equally.

If two players get a straight flush in the same hand, they will share ten percent of the progressive poker jackpot equally.

All wins flush or higher are deducted from the progressive joker jackpot. The progressive jackpot preferably starts at ten thousand dollars.

All wins for joker bonuses are deducted from the progressive joker jackpot. The progressive joker jackpot preferably starts at ten thousand dollars.

One pair, two pairs, three of a kind, or a straight will not be paid their respective bonuses unless the dealer qualifies.

The dealer always has a sixth joker that he cannot count toward the ace/joker minimum qualification.

Player's cards must always be face down if the dealer does not qualify.

There is a maximum payout of five million dollars for six jokers.

Jackpots over five hundred thousand dollars will be paid in equal installments over five years. Jackpots five hundred thousand dollars and under will be paid all at once, preferably by check.

The game may be played by as few as one person or as many as eight players per table. All eight players compete against the dealer as opposed to each other.

Players may play only one hand, i.e., five cards dealt, per game.

An incorrect amount of cards dealt to the players results in a dead hand. The player must wait until the next hand or game. The player does not lose any money. An incorrect number of cards dealt to a dealer results in a new deal. A casino supervisor decision is final.

Jokers are never wild. Thus, jokers can only be combined with each other.

The sixth joker is a community joker and any player may buy it by placing the joker side bet.

Even if the dealer does not qualify, players who made both side bets are always paid either under the joker jackpot progressive pay table for jokers or under the joker jackpot insurance.

Although the invention, has been described with reference to specific exemplary embodiments, it will be appreciated that it is intended to cover all modifications and equivalents within the scope of the appended claims.

What is claimed is:

1. A method of playing a poker-like game, the method comprising:

providing a fifty-seven card deck of playing cards that comprises one conventional deck of fifty-two playing cards and five jokers;

providing that the jokers are never wild;

at least one player anteing a first wager;

providing at least one side bet wherein said side bets correspond to a predetermined combination of cards;

each player placing any chosen side bets;

dealing a predetermined number of cards constituting a hand to each player and the dealer;

revealing at least one of the dealer's cards to the players;

each player either folding or placing a second wager;

the dealer revealing his remaining cards if at least one player did not fold;

determining if the dealer has a predetermined minimum qualifying hand;

if the dealer does not have the predetermined minimum qualifying hand, paying any player that did not fold based on the first wager and any chosen side bets;

if the dealer does have the predetermined minimum hand, comparing the hand of each player that did not fold with the dealer's hand;

determining if each player that did not fold has a winning hand based on a predetermined ranking of hands, the predetermined ranking including standard poker hands and hands having at least two jokers; wherein certain hands having at least two jokers are ranked higher than certain standard poker hands, and certain hands having at least two jokers are ranked lower than certain standard poker hands and determining if any players have a predetermined combination of cards corresponding to at least one side bet and determining if any players won any side bets.

2. The method of claim 1 wherein the dealer is dealt his cards after all players have received their cards.

3. The method of claim 1 wherein players are dealt their cards alternately.

4. The method of claim 1 wherein each player is dealt his cards all at once.

5. The method of claim 1 wherein the second wager is twice the first wager.

6. The method of claim 1 wherein a sixth joker is a community joker and any player who places a joker side bet may include the community joker as part of his hand.

7. The method of claim 1 wherein each player decides whether to place any of two side bets.

8. The method of claim 7 wherein any player who places two side bets receives joker jackpot insurance such that if any player at the table has a predetermined combination of cards and placed at least one side bet so that the predetermined combination of cards is a winning combination, the players having joker jackpot insurance also win.

9. The method of claim 1 wherein the predetermined minimum winning hand is a Joker-Ace combination.

10. The method of claim 1 further comprising determining if any players are entitled to receive a super bonus based on at least either two players having predetermined hands or the dealer and a player having predetermined hands.

11. A method of playing a poker-like game, the method comprising:

providing a fifty-seven card deck of playing cards that comprises one conventional deck of fifty-two playing cards and five jokers;

providing that the jokers are never wild;

at least one player anteing a first wager;

each player deciding whether to place at least one of a poker side bet and a joker side bet, wherein a sixth joker is a community joker and any player who makes the joker side bet may include the community joker as part of his hand;

each player placing any chosen side bets, any player placing both side bets receiving joker jackpot insurance such that if any player at the table has a predetermined combination of cards and placed at least one side bet so that the predetermined combination of cards is a winning combination, the players having joker jackpot insurance also win;

dealing a predetermined number of cards constituting a hand to each player and the dealer;

revealing at least one of the dealer's cards to the players;

each player either folding or placing a second wager;

the dealer revealing his remaining cards if at least one player did not fold;

determining if the dealer has a predetermined minimum qualifying hand;

if the dealer does not have the predetermined minimum qualifying hand, paying any player that did not fold based on the first wager and any chosen side bets;

if the dealer does have the predetermined minimum hand, comparing the hand of each player that did not fold with the dealer's hand;

determining if each player that did not fold has a winning hand based on a predetermined ranking of hands, the predetermined ranking including standard poker hands and hands having at least two jokers wherein certain hands having at least two jokers are ranked higher than certain standard poker hands, and certain hands having at least two jokers are ranked lower than certain standard poker hands; and determining if any players that did not fold have a predetermined combination of cards corresponding to at least one side bet and determining if any players won any side bets.

12. The method of claim 11 wherein the predetermined minimum winning hand is a Joker-Ace combination.

13. The method of claim 11 further comprising determining if any players are entitled to receive a super bonus based on at least either two players having predetermined hands or the dealer and a player having predetermined hands.

14. A method of playing a poker-like game, the method comprising:

providing a fifty-seven card deck of playing cards that comprises one conventional deck of fifty-two playing cards and five jokers;

providing that the Jokers are never wild;

at least one player anteing a first wager;

dealing a predetermined number of cards constituting a hand to each player and the dealer;

the dealer revealing his cards; and determining if each player has a winning hand based on a predetermined ranking of hands, the predetermined ranking including standard poker hands and hands having at least two jokers wherein certain hands having at least two jokers are ranked higher than certain standard poker hands, and certain hands having at least two jokers are ranked lower than certain standard poker hands.

15. The method of claim 14 further comprising each player deciding whether to place a side bet and each player placing any chosen side bets.

16. A method of playing a poker-like game, the method comprising:

providing a fifty-seven card deck of playing cards that comprises one conventional deck of fifty-two playing cards and five jokers;

providing that the jokers are never wild;

at least one player anteing a first wager;

dealing a predetermined number of cards constituting a hand to each player and the dealer;

revealing at least one of the dealer's cards to the players;

each player either folding or placing a second wager;

the dealer revealing his remaining cards if at least one player did not fold;

determining if the dealer has a predetermined minimum qualifying hand;

if the dealer does not have the predetermined minimum qualifying hand, paying any player that did not fold based on the first wager;

if the dealer does have the predetermined minimum hand, comparing the hand of each player that did not fold with the dealer's hand; and determining if each player that did not fold has a winning hand based on a predetermined ranking of hands, the predetermined ranking including standard poker hands and hands having at least two jokers wherein certain hands having at least two jokers are ranked higher than certain standard poker hands, and certain hands having at least two jokers are ranked lower than certain standard poker hands.

17. The method of claim 16 wherein the second wager is twice the first wager.

18. The method in claim 16 further comprising each player deciding whether to place any of two side bets and then placing any chosen side bets, and the dealer determining if any players are entitled to any winnings based on the side bets.

19. The method of claim 18 wherein a sixth joker is a community joker and any player who places a joker side bet may include the community joker as part of his hand.

20. The method of claim 19 wherein any player who places two side bets receives joker jackpot insurance such that if any player at the table has a predetermined combination of cards and placed at least one side bet so that the predetermined combination of cards is a winning combination, the players having joker jackpot insurance also win.

21. The method of claim 19 wherein six jokers constitutes the highest ranking predetermined combination of cards and jokers are the highest ranked individual card.

22. The method of claim 19 further comprising determining if any players are entitled to receive a super bonus based on at least either two players having a predetermined combination of hands or the dealer and a player having a predetermined combination of hands.

23. The method of claim 22 wherein if a player and the dealer have the predetermined combination of hands, a dealer's portion of the super bonus remains in a progressive jackpot.

24. The method of claim 23 wherein if the dealer's hand beats the player's hand, the player only receives one half a player's portion of the super bonus.

25. The method of claim 19 further comprising each player determining whether to place a side bet on the dealer's hand and then placing the side bet if so desired.

26. The method of claim 18 wherein a progressive jackpot is provided for each side bet and the amount of the jackpot determines how much is required to be wagered on the corresponding side bet.

27. The method of claim 18 wherein if a player makes a side bet and the dealer does not have the predetermined minimum hand, the player may still win his corresponding side bet.

28. The method of claim 18 wherein each side bet qualifies a player who makes the side bet for a progressive jackpot.

29. The method of claim 28 wherein the amount of the side bet determines how much of the corresponding jackpot for which a player placing the side bet qualifies.

30. The method of claim 29 wherein the amounts a player may wager for a side bet is a range between one dollar and five dollars.

31. The method of claim 16 further comprising determining if any players are entitled to receive a super bonus based on at least either two players having predetermined hands or the dealer and a player having predetermined hands.

32. The method of claim 16 wherein five jokers constitutes the highest ranking predetermined combination of cards and jokers are the highest ranked individual card.

33. The method of claim 16 wherein each player may ante a first wager and place a second wager for a poker portion of his respective hand, and wherein each player may ante a first wager and place a second wager for a joker portion of his respective hand.

34. The method of claim 33 wherein the poker portion and the joker portion of a hand each have a corresponding side bet that a player may place.

35. The method of claim 34 wherein predetermined combinations of hands are defined for the poker portion and predetermined combinations of hands are defined for the joker portion such that if players make the appropriate corresponding side bet and any of the predetermined combinations of hands occurs between at least two players or the dealer and a player, such players making the appropriate corresponding side bet win a bonus.

36. The method of claim 35 wherein the amount of any side bets wagered determines how much of a super bonus a player receives.

* * * * *